United States Patent [19]

Hella et al.

[11] Patent Number: 4,944,098

[45] Date of Patent: Jul. 31, 1990

[54] HIGH VELOCITY RUNNING WEB DRYER HAVING HOT AIR SUPPLY MEANS

[75] Inventors: Terry A. Hella, DePere; Gary L. Perry, White Lake, both of Wis.

[73] Assignee: Advance Systems, Inc., Green Bay, Wis.

[21] Appl. No.: 341,816

[22] Filed: Apr. 24, 1989

[51] Int. Cl.[5] ..... F26B 13/00

[52] U.S. Cl. ..... 34/156; 432/59; 431/62

[58] Field of Search ..... 431/62; 432/59, 60; 34/155, 156, 23, 160, 222, 229

[56] References Cited

U.S. PATENT DOCUMENTS

| | | | |
|---|---|---|---|
| 2,464,698 | 3/1949 | Logan | 431/62 |
| 3,739,491 | 6/1973 | Creapo et al. . | |
| 4,116,620 | 9/1978 | Stibbe . | |
| 4,343,769 | 8/1982 | Henkelmann . | |

*Primary Examiner*—Henry A. Bennet
*Attorney, Agent, or Firm*—Nilles & Nilles

[57] ABSTRACT

A high velocity web dryer which has a series of upper and lower air bars for floatingly suspending a running web as the web moves through the dryer. A hot air supplying system provides hot air to the bars for drying the web. The system includes a gas fired burner and a source of combustion air for the burner. A valve control is provided for controlling the admission of combustion air to the gas fired burner, and includes a movable valve for controllably admitting combustion air to the burner. The said valve control includes an initial air admitting valve for providing initial air through the valve control prior to partial opening of the valve control, to thereby provide a relatively smooth and excessive surge-free supply of air to the burner, whereby a stable air supply system in provided without oxygen starvation and without blowing out a flame of the burner. The initial air admitting valve is so sized so as to satisfy the pilot and low fire air requirements in a valve control fully closed position, and to insure proper air/gas ratio for stoichiometry combustion and minimize the pressure release and rush of air as the valve control begins to open.

6 Claims, 2 Drawing Sheets

HIGH VELOCITY RUNNING WEB DRYER HAVING HOT AIR SUPPLY MEANS

BACKGROUND OF THE INVENTION

The present invention pertains to high velocity web dryers in which a running web is floatingly suspended on air bars as it moves through the dryer. The general arrangement of this type of high velocity air web dryer and duct arrangement is shown in the U.S. Pat. No. 3,739,491 which issued June 19, 1973 to Creapo et al.

More particularly the invention pertains to means for providing heat to the interior of the dryer including a gas fired burner for heating a supply of combustion air and then delivering the heat to the interior of the web dryer. Such a general arrangement is shown in the U.S. Pat. No. 4,116,620 issued Sept. 26, 1978 to Paul H. Stibbe, and also in the U.S. Pat. No. 4,343,769 which issued Aug. 10, 1982 to Gary L. Henkelmann.

In prior art dryers of the above type, which use energy efficient burners, it is necessary to limit combustion air to a stoichiometry combustion level at all firing conditions. This is normally done with a butterfly type damper, which opens or closes as firing rate demands change. To achieve minimum firing rate and pilot flame conditions with the above type systems, the combustion air valve needed to be throttled to an almost closed position. This slightly open position created an unstable situation, with the slightest movement of throttle creating a starvation for oxygen, or an over abundance and in-rush of air which occasionally would blow the flame out.

SUMMARY OF THE INVENTION

The present invention provides a high velocity web dryer in which a running web is floatingly suspended on air bars as it moves through the dryer and more particularly the invention relates to the means for controlling the admission of combustion air to a gas fired burner for heating air which is then delivered to the air bars. One aspect of the invention relates to such a control means utilizing a positionable valve means for controllably admitting combustion air, and which valve means includes initial air admitting means for providing initial air through said valve means prior to partial opening of said valve means, to thereby provide a relatively smooth and excessive surge-free supply of air to said burner, whereby a stable air supply system is provided without oxygen starvation and without blowing out a flame of the burner.

Another more limited aspect of the invention relates to the initial air admitting means being so sized so as to satisfy the pilot and low fire air requirements in a valve fully closed position, and to insure proper air/gas ratio for stoichiometry combustion and minimize the pressure release and rush of air as the valve means begins to open.

A still more limited aspect of the invention relates to a dryer of the above type in which the valve means includes an adjustable butterfly valve, and the initial air admitting means includes aperture means in the butterfly valve.

Yet another aspect of the invention relates to a dryer of the above type wherein said initial air admitting means in a separate, adjustable and fixable valve arranged in parallelism with the remainder of the valve, the initial air admitting means being adjusted and fixable to provide a set, predetermined flow of air to the burner.

Generally, the invention relates to properly sizing the apertures in the butterfly valve which satisfy the pilot and low fire air requirements in a valve fully closed position. This arrangement insures proper air/gas ratio for stoichiometry combustion and minimizes the pressure release and rush of air as the valve damper begins to open.

These and other objects and advantages of the present invention will appear here and after as this disclosure progresses.

BRIEF DESCRIPTION OF THE DRAWINGS

FIG. 5 is a view similar to FIG. 2, but without the second air valve and showing the butterfly valve with apertures therein;

FIG. 6 is a view, taken generally along the lines 6—6 in FIG. 5 and showing the apertured butterfly valve, and;

FIG. 7 is a view, partially in section, of the FIG. 5 arrangement and taken generally along the line 7—7 in FIG. 5.

DESCRIPTION OF PREFERRED EMBODIMENTS

Figure 1:
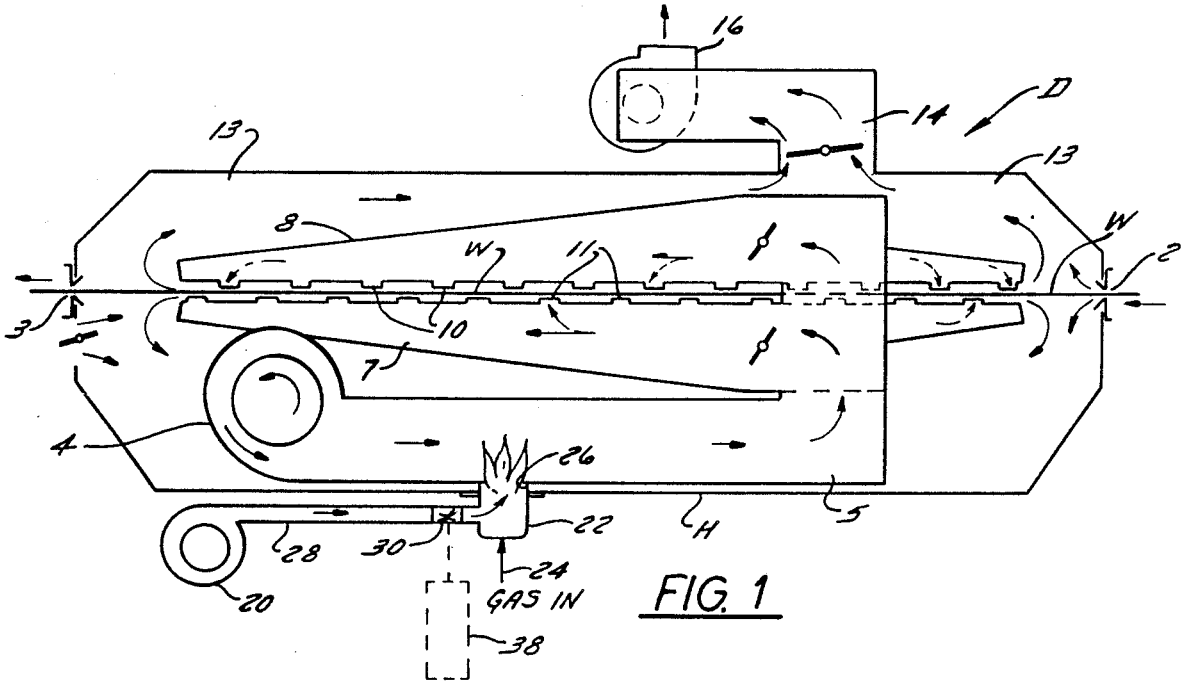
FIG. 1 is a schematic, vertical, longitudinal, cross sectional view through a dryer for floatingly suspending a web as it moves through the dryer without contact.

FIG. 1 is a schematic view of a web dryer which floatingly suspends a running web W as it passes through the dryer and without contacting the web. The dryer D includes an enclosed housing H which is of conventional character and is insulated and has access doors (not shown), and horizontal inlet slot 2 is provided at the inlet end of the dryer and through which the web enters the dryer. At the other end of the dryer housing is a horizontal exit slot 3 for the web. The web passes through the dryer at many hundreds of feet per minute and exits from the dryer in a dry condition. In installations of this type the web many be printed on each side and is floatingly suspended as it passes through the web without contacting any of the parts of the dryer.

Within the dryer housing is an air supply fan 4 which is suitably driven by a motor (not shown) and delivers high velocity air to the air supply duct 5 which in turn is in air delivering communication with the lower air supply duct means 7 and the upper air supply duct means 8. The air from the air supply duct means 7 and 8 is then delivered to the series of transversely positioned upper air bars 10 and lower air bars 11 which are located, respectively, on the upper and lower sides of the running web W. The upper air bars 10 are longitudinally staggered in relationship to the lower air bars 11 so that the web passes in a sine wave form of conventional character through the dryer. The spent air, after it passes through the air bars to perform its drying function flows into the general interior 13 of the enclosed housing H and is exhausted therefrom via the exhaust duct 14 with the aid of the exhaust fan 16.

Means are provided for furnishing hot air to the air supply duct 5 for the purpose of furnishing heat for drying the running web. This means includes a combustion blower 20 for furnishing air to a gas burner 22 and gas is supplied from a conventional source (not shown) through the pipe 24 to the burner 22 where it is mixed with air from blower 20 and results in the heated air being delivered via the burner outlet 26 attached in communication with the duct 5 to the interior of the air supply duct 5 located within the housing H. The supply air is delivered from the combustion blower 20 via the pipe 28 to the burner 22.

Before entering the burner, the air passes through an adjustable butterfly valve 30 in a reduced area 29 of the pipe, which valve 30 is adjustable by the slotted link 31 fixed at one end to the oscillatably mounted shaft 32. Link 33 is pivotally connected by pin 34 and is moved by the slotted link 35. Link 35 (FIG. 5) is attached to shaft 36 and is thus oscillatably moved, in the conventional manner, by the positioner motor 38.

In installations of the present type, on energy efficient burners it is necessary to limit combustion air to a stoichiometry combustion level at all firing conditions. This is normally done with a butterfly damper shown above, which opens or closes as firing rate demands change.

To achieve minimum firing rate and/or pilot flame conditions with the above type system, the combustion air valve needed to be throttled to an almost closed position, i.e. slightly open position. This slightly open position created a unstable situation in which, with the slightest movement of throttle it created a starvation for oxygen, or an overabundance and in-rush of air which occasionally would blow the flame out. The prior art burners currently used, for example, have a minimum firing rate or pilot of 50,000 BTU. The combustion air required for this firing rate is: 9.2 CFM. Based upon the following: 167 CFM per million BTU is a stoichiometry combustion level. It is necessary to furnish 10% excess air for assurance of complete combustion.

$$\text{So: } 167 \times 1.1 = 184 \text{ CFM/Million BTU.}$$

$$184 \times \frac{50{,}000}{1{,}000{,}000} = 9.2 \text{ CFM.}$$

This typical tight shut off butterfly as used for this type of application can only control down to 5% to 8% of full design flow. Present design flow for these "butterflies" range from 252 to 751 CFM. 5% of 252 is 12.6 CFM. 8% of 252 is 20.16 CFM. 5% of 751 is 37.55 CFM. and 8% of 751 is 60.08 CFM.

This indicates that even at the best of conditions, the arrangement is above the desired air flow.

In accordance with the present invention control means for the combustion air has been provided which establishes minimum combustion air flow requirements. This provides burner firing enhancement on energy efficient burners which fire into high back pressure plenum chambers, as follows.

Generally, the improved control means utilizes a positionable valve means for controllably admitting combustion air, and which valve means includes initial air admitting means for providing initial air through said valve means prior to partial opening of said valve means, to thereby provide a relatively smooth and excessive surge-free supply of air to said burner, and furnish minimum design firing rate of the burner, whereby a stable air supply system is provided without oxygen starvation and without blowing out a flame of the burner.

Figure 6:
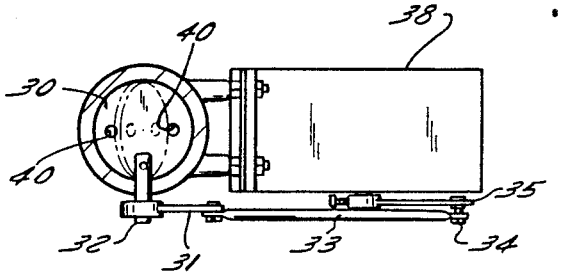
FIGS. 5, 6 and 7 are modifications of the air supply means shown in FIGS. 2, 3 and 4.
Figure 7:
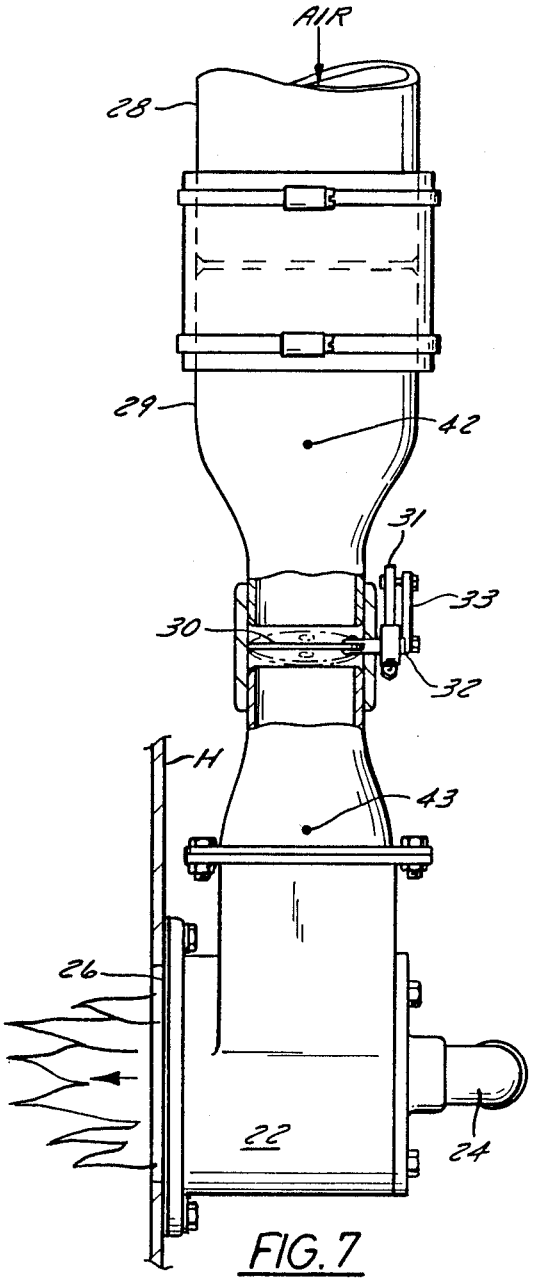
Figure 5:
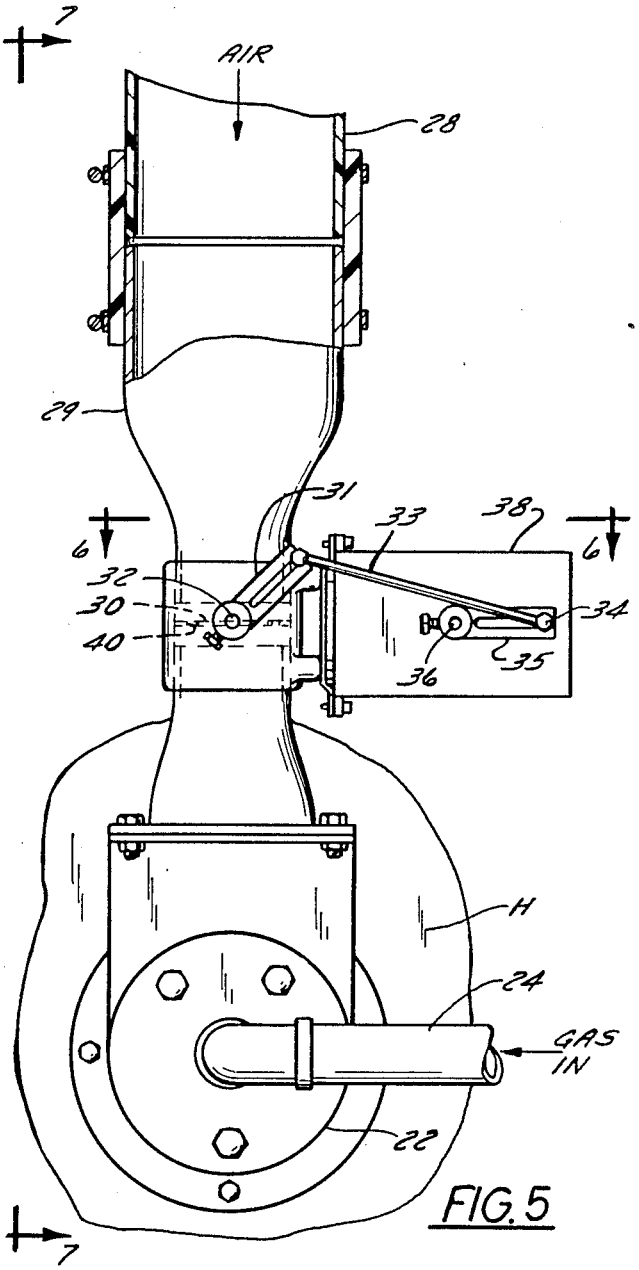

FIGS. 5, 6 and 7

One form of the invention is where the valve means includes an adjustable butterfly valve, and the initial air admitting means includes aperture means in the butterfly valve.

More specifically, the valve means includes apertures 40 in the butterfly valve 30 itself as shown in FIGS. 5, 6 and 7, where a pair of orifices or apertures 40 are located and which are, for certain installations for example, of a size of about ⅜ inch in diameter.

The apertures 40 provided in the butterfly damper 30 are properly sized to satisfy the pilot and low fire air requirements with this damper in a full closed position. This insures proper air/gas ratio for stoichiometry combustion during these conditions and minimize the pressure relief and rush of air as the damper begins to open. This improvement has resulted in elimination of problems in these firing conditions.

Because of the above, the size of the orifices 40 of the valve it provides for more reliability of control over our broad range of variables. The calculations for sizing the orifices are as follows.

Reference will be made to delta pressure which is the difference in pressure across the reduced or venturi portion 29 of the pipe 28, such as between points 42 and 43 (FIG. 7). The delta air pressure required to achieve firing rates on the burners range from 6.5" water column to 12.4" water column, for an average delta pressure of 9.2" water column.

By using the following formula:

$$\text{Flow in CFM} = 27.6417 \times \text{Orifice area} \times \text{Coefficient of Dischage} \times \sqrt{\frac{\text{Delta pressure In. } W.\ G.}{\text{Specific Gravity}}}$$

And the following:

The Coefficient of discharge for the orifice = 0.65.

The specific gravity of standard air = 1.

Two ⅜" dia. orifices per butterfly damper provide the proper size for typical application range. This gives an air flow at the lowest condition of 6.5" delta pressure of 10 CFM, and at the worst condition of 12.4" delta pressure of 14 CFM.

The above improvement gives far better turn down and control of the burner with minimum variables of calculations or other confusion.

Figure 4:
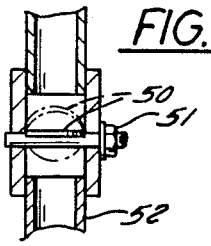
FIG. 4 is a sectional view of the lockable valve shown in FIGS. 2 and 3, but on an enlarged scale, the view being taken along the line 4—4 in FIG. 3.
Figure 2:
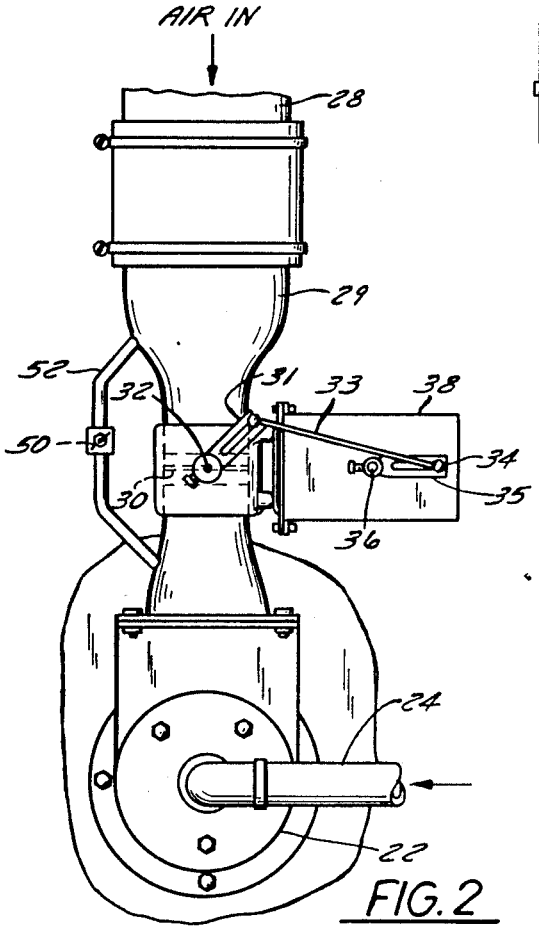
FIG. 2 is a fragmentary, elevational view of a gas burner and air supply means shown generally and schematically in FIG. 1, but on an enlarged scale, certain parts being broken away or removed for the sake of clarity.
Figure 3:
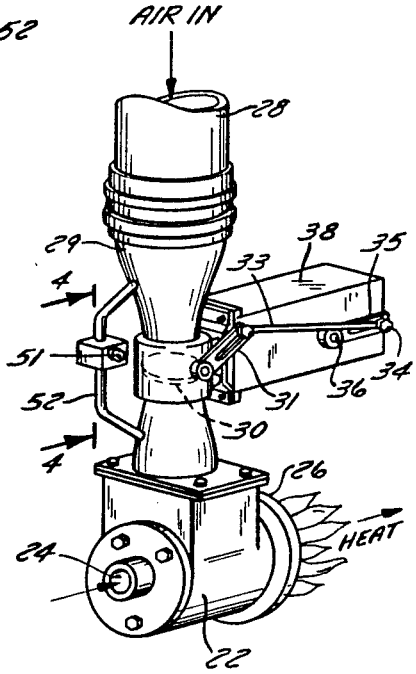
FIG. 3 is a fragmentary perspective view on a smaller scale, of the arrangement shown in FIG. 2.

FIGS. 2, 3 and 4

A modification of the invention is where the initial air admitting means is a separate, adjustable and fixable valve arranged in parallelism with the remainder of the valve, the initial air admitting means being adjusted and fixable to provide a set, predetermined flow of air to the burner.

This modification of the invention shown in FIGS. 2, 3 and 4 provides a more precise operation by exactly sizing the orifice for each particular installation. This precise adjustment for each installation is shown as a manually adjustable small valve 50 which can be precisely adjusted for the installation and then locked by nut 51 in place. The valve 50 is arranged in parallelism with an unapertured main butterfly valve and is in the conduit 52 which circumvents the butterfly valve and places the upper and lower portions of the conduit 29 in communication with one another. This modified form of the invention eliminates the need for exact orifice sizing of the butterfly valve for each installation.

By means of placing the small damper valve 50 in parallelism with a larger conventional main control damper, there is provided an adjustment which is more precisely suitable to the particular installation and results in the ability to maximize efficiency of operation.

We claim:

1. A high velocity web dryer having a series of upper and lower air bars for floatingly suspending a running web as the web moves through the dryer, means for furnishing hot air to said bars for drying the web, said means including a gas fired burner and a source of combustion air for said burner, and control means for controlling the admission of combustion air to said gas fired burner, said control means including adjustable valve means for controllably admitting combustion air to said burner, said valve means including initial air admitting means for providing initial air through said valve means prior to partial opening of said valve means, to thereby provide a relatively smooth and excessive surge-free supply of air to said burner, whereby a stable air supply system is provided without oxygen starvation and without blowing out a flame of the burner.

2. The dryer set forth in claim 1 wherein said initial air admitting means is so sized so as to satisfy the pilot and low fire air requirements in a valve fully closed position, and to insure proper air/gas ratio for stoichiometry combustion and minimize the pressure release and rush of air as the valve means begins to open.

3. The dryer described in claim 1 wherein said valve means includes an adjustable butterfly valve, and said initial air admitting means includes a aperture means in said butterfly valve.

4. The dryer as set forth in claim 1 wherein said initial air admitting means is a separate adjustable and fixable valve arranged in parallelism with the remainder of said valve means, said initial air admitting means being fixable to provide a set, predetermined flow of air.

5. A high velocity web dryer having a series of upper and lower air bars for floatingly suspending a running web as the web moves through the dryer, means for furnishing hot air to said bars for drying the web, said means including a gas fired burner and a source of combustion air for said burner, and control means for controlling the admission of combustion air to said gas fired burner, said control means including a positionable butterfly valve for controllably admitting combustion air to said burner, said butterfly valve having aperture means therein to provide a relatively smooth and excessive surge-free supply of air to said burner, whereby a stable air supply system is provided without oxygen starvation and without blowing out a flame of the burner.

6. The dryer set forth in claim 5 wherein said aperture means in the butterfly valve are so sized so as to satisfy the pilot and low fire air requirements in valve fully closed position, and to insure proper air/gas ratio for stoichiometry combustion and minimize the pressure release and rush of air as the valve begins to open.

* * * * *